US005961300A

United States Patent [19]

Pitzer et al.

[11] Patent Number: 5,961,300

[45] Date of Patent: Oct. 5, 1999

[54] DIAPHRAGM PUMP PLURAL COMPONENT DISPENSING SYSTEM WITH INTEGRATOR

[75] Inventors: Jan E. Pitzer, Eden Prairie; Kenneth E. Lehrke, Maple Grove, both of Minn.

[73] Assignee: Graco Inc., Minneapolis, Minn.

[21] Appl. No.: 08/912,962

[22] Filed: Aug. 7, 1997

Related U.S. Application Data

[63] Continuation of application No. 08/388,636, Feb. 8, 1995, abandoned.

[51] Int. Cl.[6] ..... F04B 43/06; F04B 45/00

[52] U.S. Cl. ..... 417/395; 417/393; 417/426

[58] Field of Search ..... 417/393, 395, 417/521, 364, 426, 427

[56] References Cited

U.S. PATENT DOCUMENTS

| | | | |
|---|---|---|---|
| 3,013,497 | 12/1961 | Schneider | 417/426 |
| 3,033,218 | 5/1962 | Callen | 137/99.5 |
| 3,591,051 | 7/1971 | Mitchell et al. | 222/56 |
| 4,030,860 | 6/1977 | Standlick | 417/63 |
| 4,037,616 | 7/1977 | Pinkerton | 417/393 |
| 4,076,465 | 2/1978 | Pauliukonis | 417/393 |
| 4,093,404 | 6/1978 | Soehngen | 417/507 |
| 4,131,395 | 12/1978 | Gusmer et al. | 417/426 |
| 4,178,240 | 12/1979 | Pinkerton | 417/393 |
| 4,304,529 | 12/1981 | Gerich | 417/393 |
| 4,381,180 | 4/1983 | Sell | 417/393 |
| 4,682,714 | 7/1987 | Bohnensieker | 222/137 |
| 4,684,332 | 8/1987 | Hartley | 417/397 |
| 4,708,827 | 11/1987 | McMillin | 417/393 |
| 4,915,599 | 4/1990 | Katsuyama et al. | 417/393 |
| 4,953,754 | 9/1990 | Credle | 222/129 |
| 5,058,768 | 10/1991 | Lickfield | 222/1 |
| 5,071,038 | 12/1991 | Credle | 222/129 |
| 5,217,146 | 6/1993 | Neff et al. | 222/137 |
| 5,279,504 | 1/1994 | Williams | 417/393 |

*Primary Examiner*—Timothy S. Thorpe
*Assistant Examiner*—Ted Kim
*Attorney, Agent, or Firm*—Douglas B. Farrow

[57] ABSTRACT

A relatively inexpensive and easy to operate plural component dispensing apparatus is made up of one or more double sided pumps, such as an air-operated double diaphragm pump. The manifolding on the pumps is divided so that each side of the pump pumps one of the components of the plural component material with an integrator (18) attached to the outputs of the two sides to bring the out-of-phase output of the pump into phase. Diaphragm type isolation valves (116) are optionally provided on the output of each side of the pump in order to prevent back flow of mixed material. In the event that ratios other than 1:1 are required, more than one such pump may be used together in order to result in a variety of ratios.

6 Claims, 7 Drawing Sheets

DIAPHRAGM PUMP PLURAL COMPONENT DISPENSING SYSTEM WITH INTEGRATOR

This application is a continuation of application Ser. No. 08/388,636, filed Feb. 8, 1995, now abandoned.

BACKGROUND OF THE INVENTION

In recent years various types of plural component materials, particularly in the paints and coating areas, have become increasingly popular for a number of reasons. Such coatings offer a number of desirable properties such as durability and decreased environmental emissions. Such materials do present a problem, however, in that they need to be mixed only very shortly before they are applied to a product to be finished. Also, many are also quite sensitive in terms of the ratio between the two (or more) components involved.

While double sided pumps have been used in the past to pump plural component materials, that experience has been less than satisfactory for a number of reasons. For instance, U.S. Pat. No. 5,094,596 discloses utilizing a pump to pump different materials from the two sides but gives only an indication that a static mixer could be used, clearly unsatisfactory for continuous line processes where accurate ratio is at all times required. In addition, the pump mentioned in that patent is a relatively high pressure pump and is substantially more expensive than other types of pumps for many applications.

In addition, air-operated double diaphragm pumps have been utilized for a number of years in a split manifold configuration typically to pump windshield washer concentrate through one side and water through the other. There has been no criticality in such applications as it is not a continuous line process. Rather, the two components are merely batch mixed in the windshield washer reservoir or other container being filled and the complete batch ratio is all that is important.

SUMMARY OF THE INVENTION

It is therefore an object of this invention to provide a plural component apparatus which is easily and inexpensively manufactured, is easy to operate, and which is relatively resistant to back flow and other situations which would allow hardening of mixed material within the system which typically presents problems in cleaning.

It is further an object of this invention to provide a mechanism which is capable of being used with a number of different mix ratios where desired.

The device of the instant invention utilizes the two sides of an air operated double diaphragm pump to pump separate fluids. A 1:1 version simply mixes the outputs of the two sides in an integrator followed by a static mixer before utilization by an application device such as a spray gun. The integrator takes the sequential slugs (first from the left side of the pump, then the right side of the pump, etc.) and aligns them parallel, like the stripes of a two color toothpaste. The static mixer then finely mixes these "stripes" into a homogenous fluid.

More complex ratios may be obtained by using two pumps where simple air logic counts strokes or cycles of one pump to operate the other pump and vice-versa. Odd ratios may be obtained by shortening the stroke length of one of the pumps to obtain any ratio desired.

No electrical devices are included in this system which allows a low cost installation in a flammable atmosphere such as a paint booth as compared to the relatively expensive explosion proofing requirements for electrical installations.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
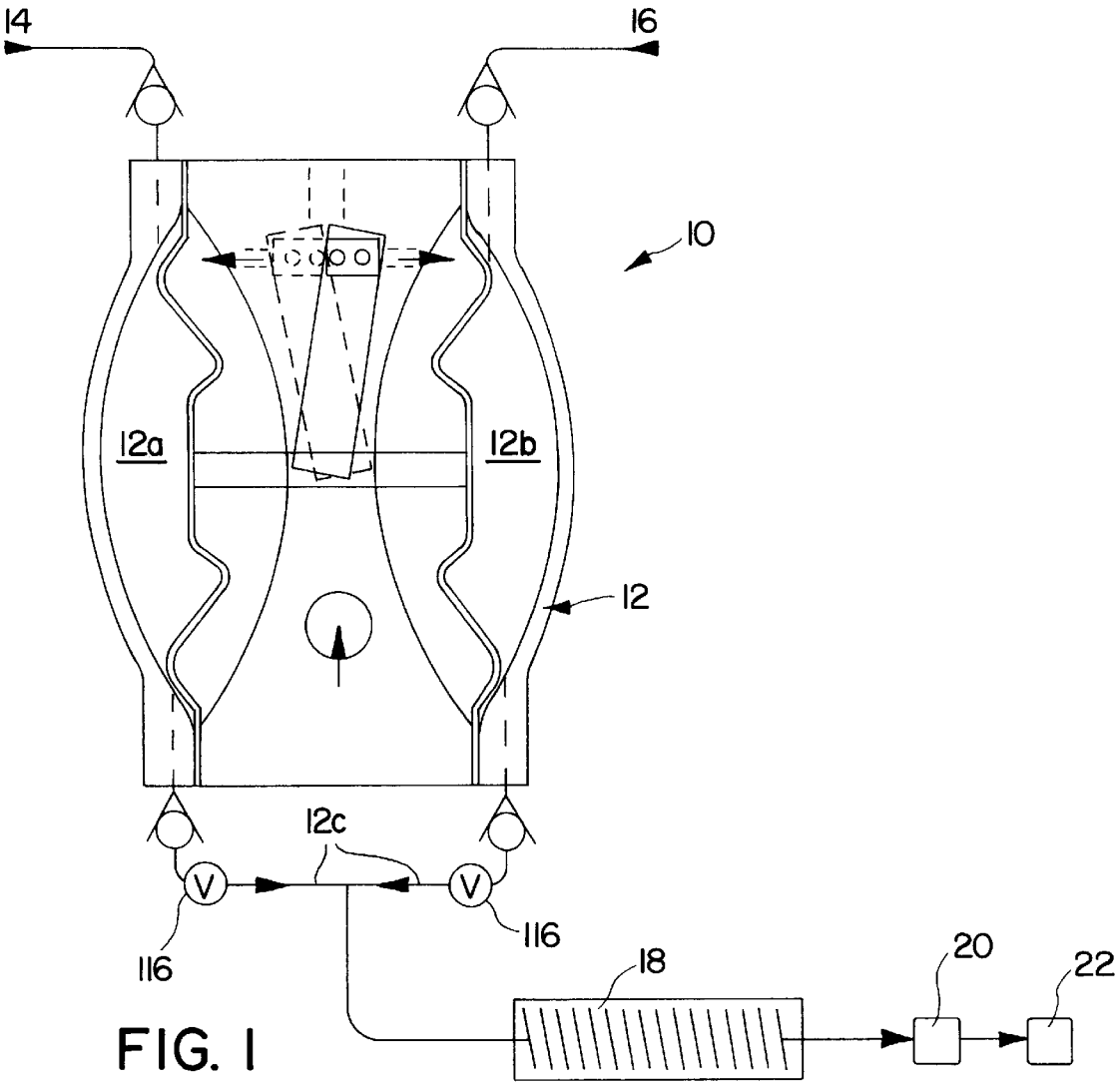
FIG. 1 is a view of a first embodiment of the instant invention.
Figure 2:
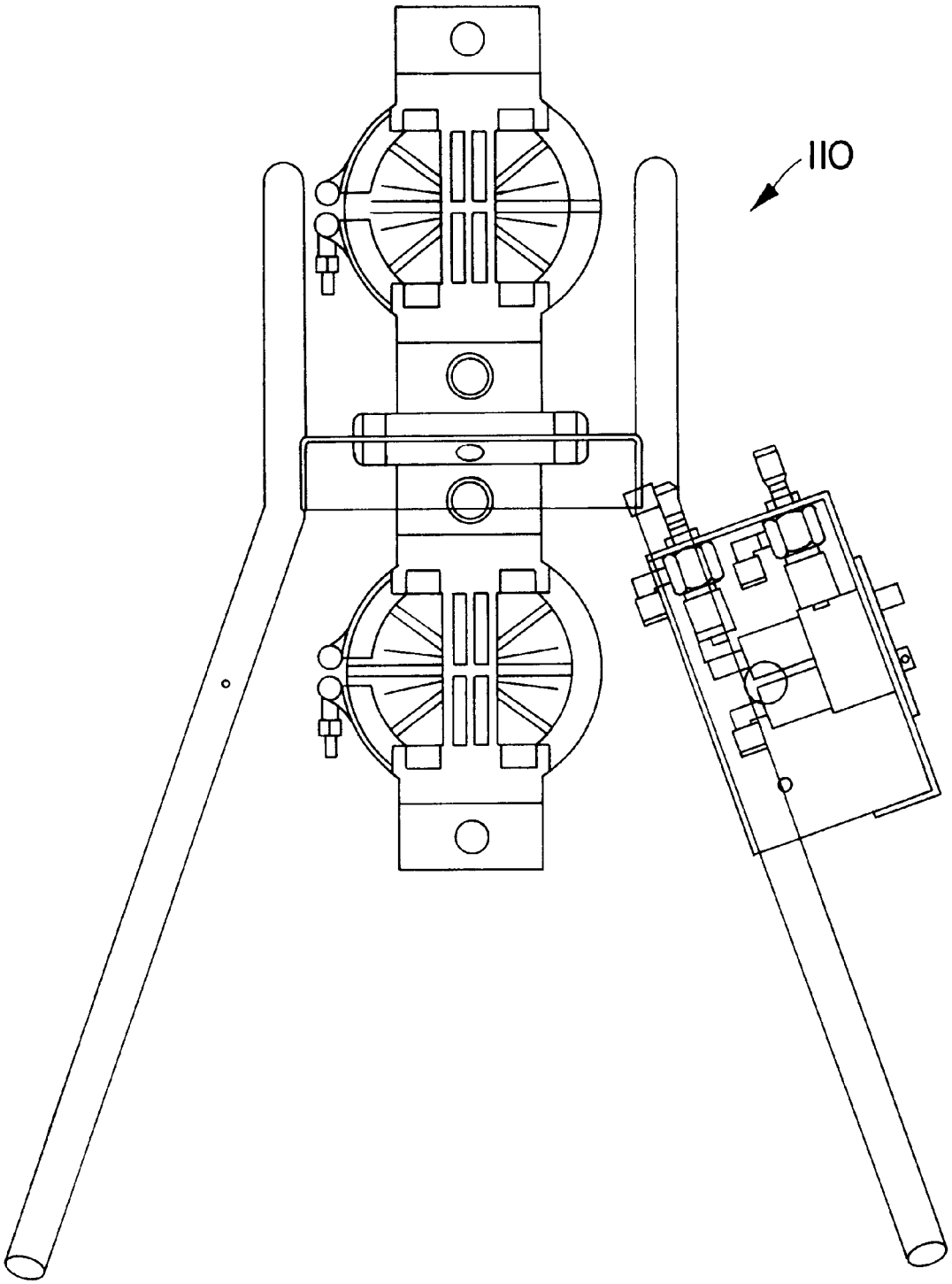
FIG. 2 is a side view of the instant invention of FIG. 1.

The instant invention, generally designated 10, is shown in FIG. 1 and is comprised of (in the preferred embodiment) an air operated double diaphragm pump 12 connected to first and second fluid sources 14 and 16 respectively, and having its outlet connected to an integrator 18 of the type generally shown in U.S. Pat. No. 5,277,494 (the contents of which are incorporated by reference). The output of the integrator is in turn fed to a static mixer 20 and then to an application device 22.

An air operated double diaphragm pump 12 such as the unit manufactured by the assignee of the instant invention and marketed under the model designation HUSKY 307 is provided with a split manifold configuration such that the two pumping chambers 12*a* and 12*b* respectively pump fluids A and B which are provided from fluid sources 14 and 16 respectively. The outlet manifold 12*c* joins the fluids for transport to integrator 18 and thence to static mixer 20.

The functioning therein is described more fully in the previously mentioned patent covering the integrator. The out-of-phase fluids provided by the alternate pumping of air operated double diaphragm pump 12 are brought into phase in integrator 18. Further mixing takes place in static mixer 20 providing a nicely homogeneous mixture for use with application device 22. The device shown in FIG. 1 is suited for pumping 1:1 mixtures for materials which require equal parts of the two components.

Figure 3:
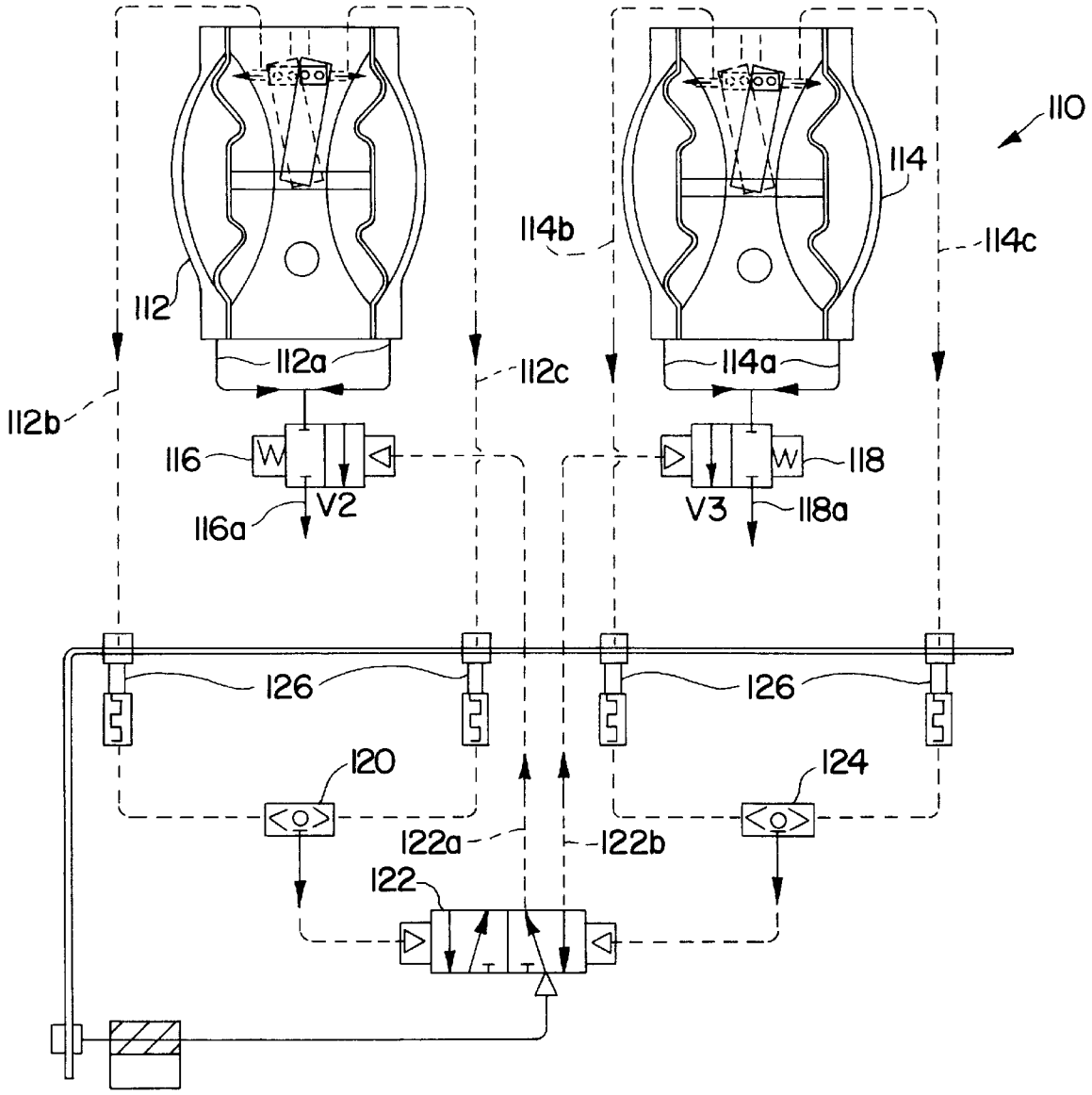
FIG. 3 is a schematic view of another embodiment of the instant invention.

Turning to FIG. 3, first and second air operated double diaphragm pumps 112 and 114 have their inlets each connected to the different fluids, pump 112 being connected to fluid A and pump 114 being connected to fluid B. The outlets 112*a* of pump 112 are connected to first fluid valve 116 while pump 114 outlets 114*a* are connected to second fluid valve 118. Isolation valves 116 and 118 will be described in more detail hereinafter. The outlets 116*a* and 118*a* of the isolation valves 116 and 118 are attached to the inlet of an integrator 18 such as that shown in FIG. 1.

The rest of the system downstream of integrator 18 is also the same as shown in FIG. 1 and is not shown in FIG. 3 and following for sake of clarity. The device shown in FIGS. 3 (and 2) without change will also produce a 1:1 mixture ratio. This device may be easily changed to a 2:1 ratio by disconnecting one of the air signal outputs 112*b* and 112*c*. The air signal outputs 112*b* and 112*c* are literally the air which is fed to the inner side of the diaphragms to produce movement and in turn converted to a pulse signal (of approximately 500 milliseconds) by pulse valves 126. In general operation, air signals 112*b* and 112*c* are fed to a first OR valve 120 which in turn outputs to first side of a 4-way double piloted valve 122.

Similarly, second pump air signals 114*b* and 114*c* are fed to a second OR valve 124 which in turn goes to the other side of 4-way double piloted valve 122. The two outlets of the 4-way double piloted valve 122*a* and 122*b* respectively are plumbed to first and second isolation valves 116 and 118. This valving arrangement causes the isolation valves to alternate one stroke from pump 112 with one stroke from pump 114 thereby providing alternating shots of the first and second fluids. The isolation valves 116 and 118 prevent both pumps from pumping at once and also prevent fluid from flowing back into the pumps thereby preventing mixing at a point earlier than that desired in the system.

Figure 6:
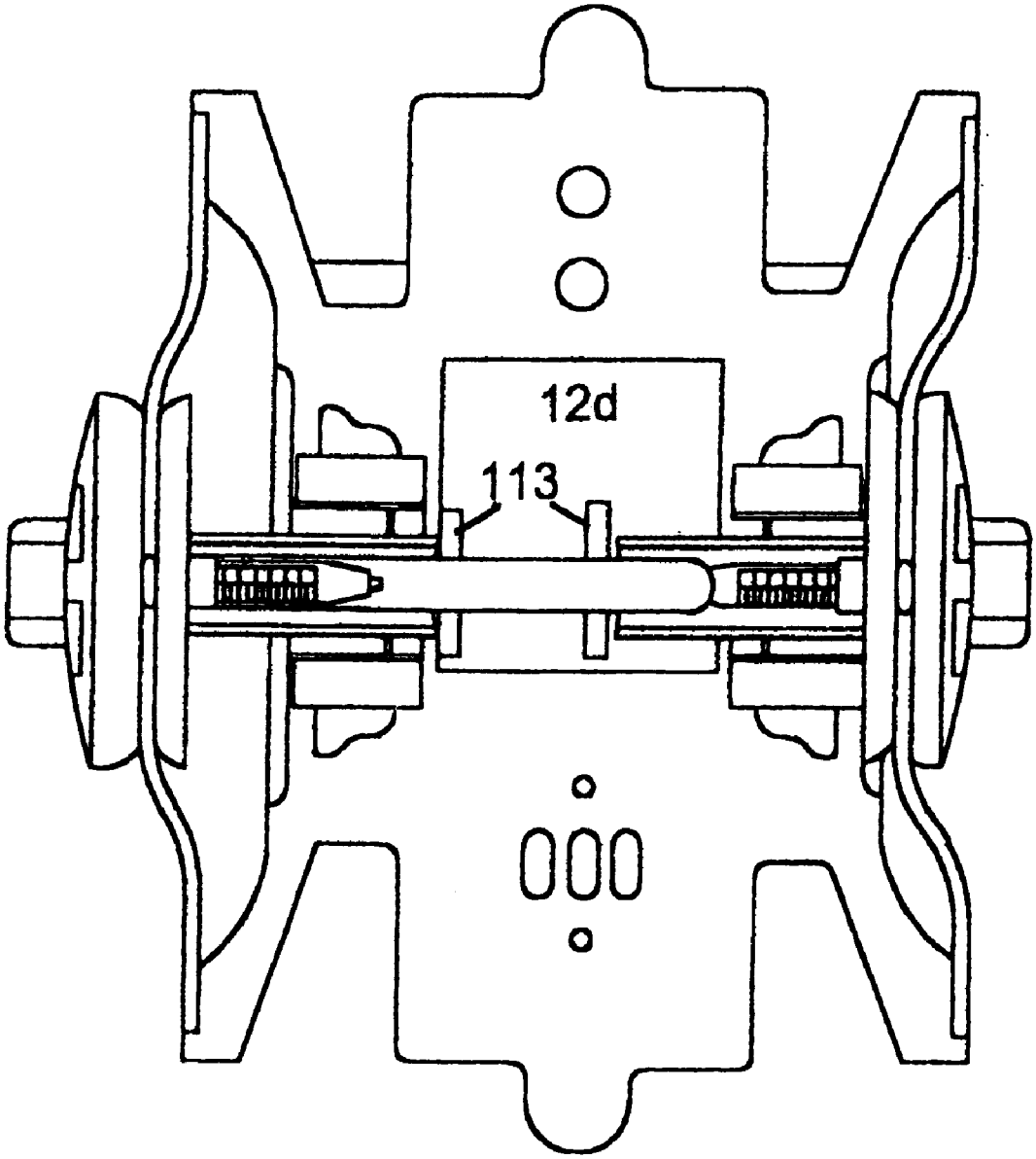
FIG. 6 is a cross-sectional view of the pump air valve showing spacer addition.

To provide the 2:1 ratio, one of the air signals 112*b* or 112*c* from pump 112 is disabled either by means of disconnection or by insertion of a simple valve in the line. Now pump 112 counts cycles while pump 114 counts strokes, which produces a basic 2:1 ratio. To obtain a ratio of, for example 5:3, the same concept is used except the stroke length of pump 114 is mechanically limited to 3/5 that of pump 112 as shown in FIG. 6. This allows achieving multiple ratios with the same simple, reliable, low cost air logic as shown.

The air signal 112*b* or 112*c* is derived by tapping the air side of each diaphragm for signal air. In operation, the output of air signals 112*b* or 112*c* is selected by OR valve 120 and actuates one side of valve 122. This directs signal line 122*b* to actuate isolation valve 118 thereby turning on pump 114. Similarly, pump 112 stalls against closed valve 116 until pump 114 completes its stroke. The pump 114 changeover signal is then fed through 114*b* or 114*c* and OR valve 124 to valve 122 thereby causing valve 122 to flip and turning isolation valve 116 on and isolation valve 118 off. Now pump 116 outputs fluid and pump 114 stalls. This sequence continuously repeats.

Figure 4:
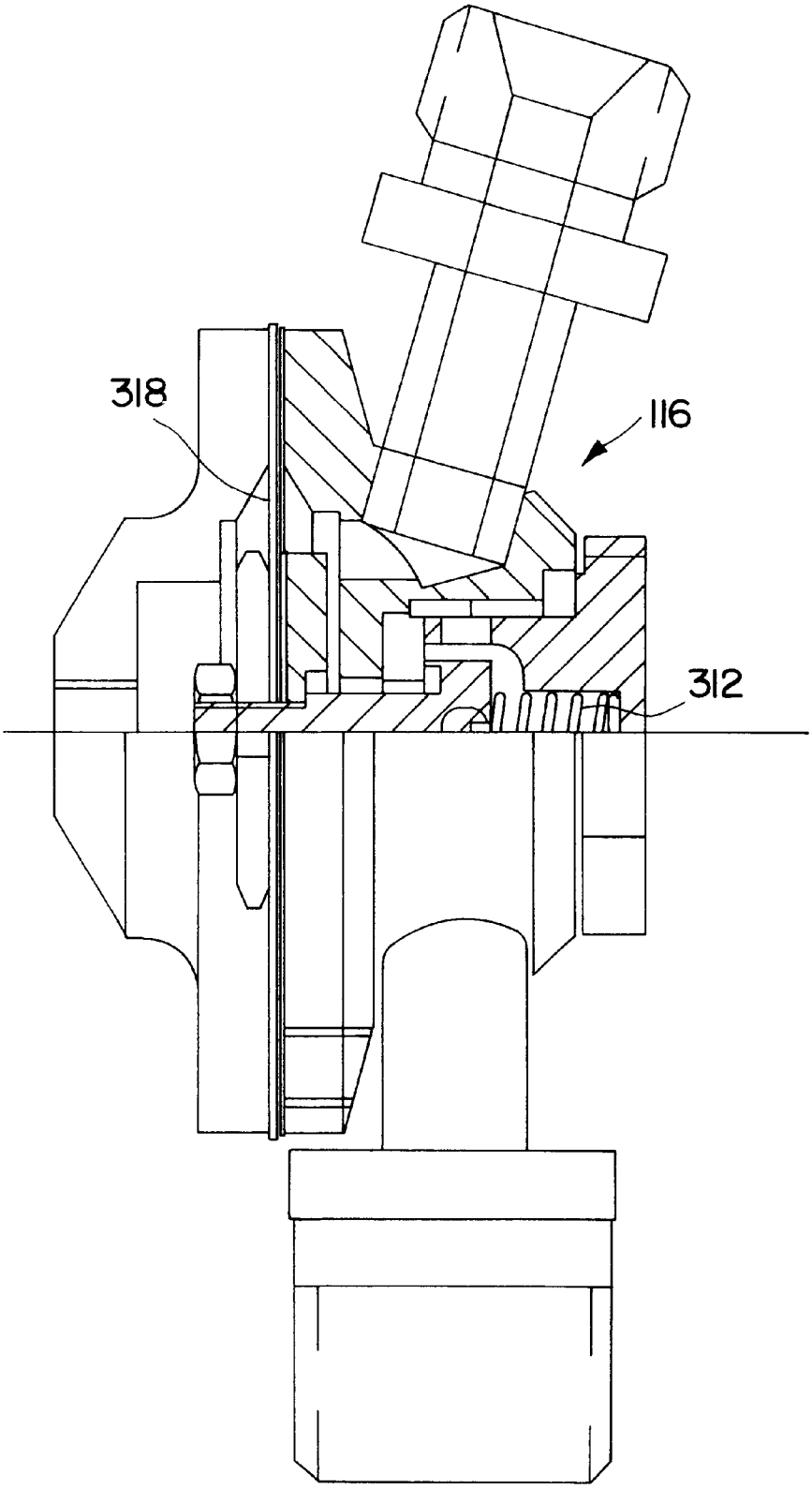
FIG. 4 is a partial cross-sectional view of the isolation valve of the instant invention.

Fluid valves 116 and 118 are diaphragm sensing fluid pressure regulators converted to operate as valves as shown in FIG. 4. To make this change, this improvement using diaphragm isolation is critical because the hardener fluid (also referred to as catalyst) is often sensitive to air and will readily harden. A typical stem operated valve will be troublesome and unreliable because of the hardener drying on its stem as it moves in and out of its packing. The diaphragm isolated valve eliminates this problem. The isolation valves 116 and 118 comprise wetted parts, open and closed states, and a flow path therethrough wherein said wetted parts are always in said flow path.

The valve is derived from a presently available low cost regulator such as Graco's regulator part number 214-895. In the valve mode, the pressure setting spring is removed and the regulator output becomes the valve input. A biasing spring 312 biases poppet 314 against seat 316. The fluid entering the inlet further forces the poppet against the seat by adding its force to the bottom side of diaphragm 318. The valve opens only when a counteracting force is applied to the other side of the diaphragm. This force does not have to be equal to the fluid force as the fluid force is applied in both directions against the diaphragm and the valve poppet. The valve has gain which is important so that the valve opens with equal fluid and air pressures.

As shown in FIG. 6, additional ratios may be obtained by placing spacers 113 on the connecting rod 12*d* of any of the pumps. The operation of the air valve contemplated is shown in U.S. Pat. No. 5,240,390 (the contents of which are incorporated by reference) and by changing the thickness of the spacers 113, various ratios may be produced. The effect of placing spacers 113 on the connecting rod 12*d* is to shorten the stroke which accordingly cuts the output of the pump, thus almost any ratio may be obtained by judicious juggling of the stroke length. For instance, inserting spacers 113 having a thickness of 0.081 inches in one of the two aforementioned Husky 307 pumps will produce a ratio of 5:3.

Figure 5:
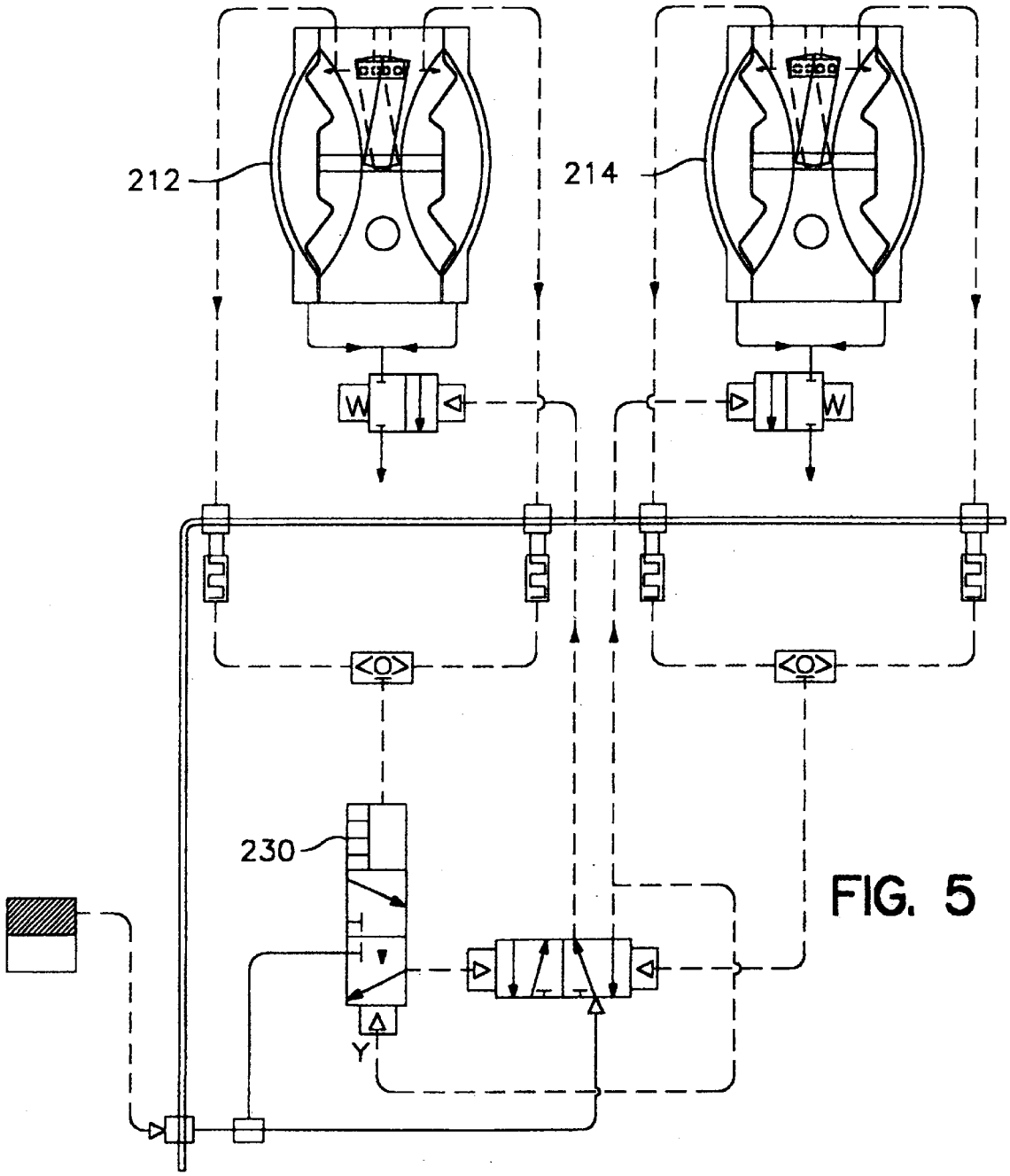
FIG. 5 is a schematic view of yet another embodiment of the instant invention.

Additional higher ratios may be obtained using the device shown in FIG. 5 which operates similar of that shown in FIG. 3 except that a counter 230 is inserted into the circuit. This allows the setting of any number of counts desired from pump 212 for each stroke of pump 214. Now the limit of ratio range becomes the integrator size because of its ability to realign or integrate the shots from each pump.

Figure 7:
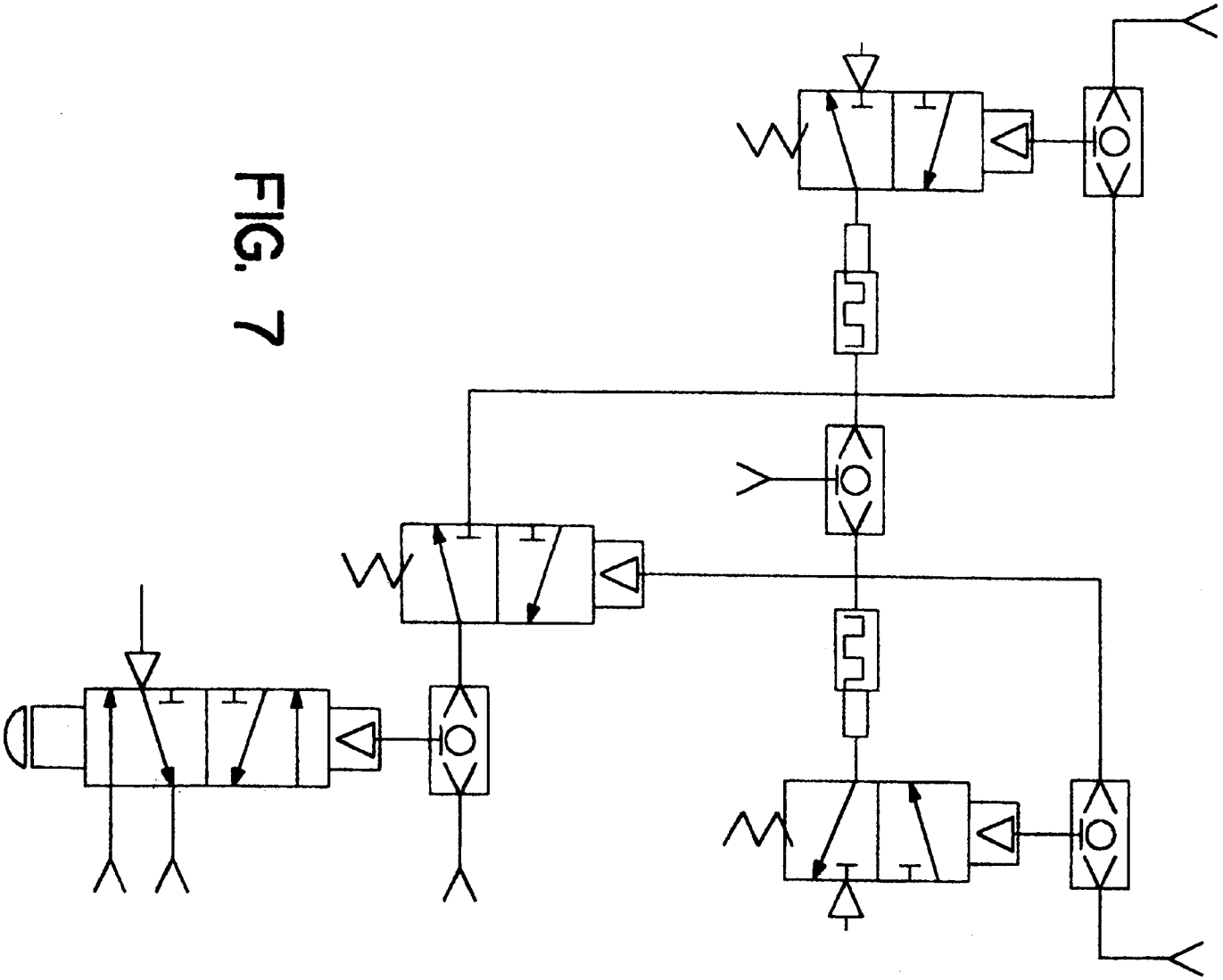
FIG. 7 is a schematic view of yet another embodiment of the instant invention.

A pump stroke that occurs too rapidly indicates a fault in a pump, such as faulty check valve operation and thereby a volume output error. A circuit may be used to sense this and trigger an alarm or shut down the system thereby insuring more reliable system performance. The fault is based on the fact that a fully loaded pump stroke will require in the area of 1.0 seconds or more to unload through any normal system restrictions, for example hoses, spray tip, etc. An unloaded pump (from running out of paint, for example) or loss of restriction allows a much faster pump stroke on the order of 0.5 seconds. Sensing when the approximately 0.5 second pulse valve outputs are coincident provides a simple low cost method of determining a fault condition. Two pulse valves, 3 pilot valves and a flip-flop valve are added for this function. A schematic showing such a design is shown in FIG. 7.

It is contemplated that various changes and modifications may be made to the plural component system without departing from the spirit and scope of the invention as defined by the following claims.

What is claimed is:

1. An apparatus for dispensing plural component materials, said apparatus comprising:

at least one double sided pump, each said pump having first and second pumping chambers, each said chamber having an inlet and an outlet, at least one of said chamber inlets being connected to a source of a first material and at least another of said chamber inlets being connected to a source of a second material, the chambers of each said pump outputting alternating shots of said first and second materials to which the chamber inlet is connected to; and a fluid integrator having an inlet and an outlet, said integrator inlet being connected to said chamber outlets, said integrator being sized to produce a homogenous mixture when said chambers pump alternating shots of said first and second materials.

2. The apparatus of claim 1 further comprising an isolation valve connected to each said chamber outlet and means for externally operating each said isolation valve so as to allow it to open when the chamber to which it is attached outputs fluid.

3. The apparatus of claim 2 further comprising a check valve; said isolation valve being located between said check valve and said integrator.

4. The apparatus of claim 2 wherein said isolation valve comprises wetted parts, open and closed states, and a flow path therethrough wherein said wetted parts are always in said flow path.

5. The apparatus of claim 1 further comprising a static mixer.

6. The apparatus of claim 1 further comprising first and second pumps wherein one of said pumps is provided with an adjustable stroke.

* * * * *